United States Patent [19]

Hanson et al.

[11] 4,030,214

[45] June 21, 1977

[54] ADJUSTABLE FLEXURE MEANS FOR SKI BOOT

[75] Inventors: Alden B. Hanson; Chris A. Hanson; Donald W. Bertetto, all of Boulder, Colo.

[73] Assignee: Hanson Industries Inc., Boulder, Colo.

[22] Filed: Mar. 21, 1975

[21] Appl. No.: 560,994

[52] U.S. Cl. ..... 36/105; 36/118

[51] Int. Cl.[2] ..... A43B 21/00; A43B 5/04

[58] Field of Search ..... 36/2.5 R, 2.5 AL, 50, 36/105, 118; 12/113

[56] References Cited

UNITED STATES PATENTS

| | | | |
|---|---|---|---|
| 827,987 | 8/1906 | Miles et al. | 12/113 |
| 3,848,347 | 11/1974 | Hanson et al. | 36/2.5 AL |

FOREIGN PATENTS OR APPLICATIONS

| | | | |
|---|---|---|---|
| 933,253 | 4/1948 | France | 36/2.5 AL |
| 1,941,025 | 2/1971 | Germany | 36/117 |
| 1,941,258 | 2/1971 | Germany | 36/117 |

*Primary Examiner*—Patrick D. Lawson

*Attorney, Agent, or Firm*—Merriam, Marshall, Shapiro & Klose

[57] ABSTRACT

Ski boot with a semi-rigid shell and flex-adjusting means. A vertical split portion in the shell is provided with apertures on each side of the split spaced along its length. A clip including two spaced parallel legs is inserted from the inside of the boot into a selected pair of apertures to limit the extent of separation of the split in response to pressure on the boot, thus controlling the flex of the boot.

6 Claims, 5 Drawing Figures

ADJUSTABLE FLEXURE MEANS FOR SKI BOOT

This invention relates to a ski boot of the type comprising a substantially rigid outer shell, wherein provision is made for adjustment of the flex of the boot as desired by the wearer thereof, without the necessity for using any tools.

Many ski boots presently available comprise a substantially rigid outer shell generally made of plastic material. A liner member is normally disposed within the shell and serves as a cushion between the shell and the foot of the skier. At various times during skiing maneuvers, the skier's leg will exert pressure on portions of the shell, which will be resisted to a greater or lesser extent depending on the inherent rigidity of the shell.

The proper amount of flex in a ski boot depends on the particular desires and skiing ability of the user thereof. Generally, expert skiers and racers desire a minimum of flex in the shell so that maximum degree of response of the skis to leg movements of the skier is afforded. A relatively rigid boot of this type, however, although affording maximum control, is also relatively uncomfortable and is, therefore, not desired by average or recreational skiers to whom reasonable comfort is usually a matter of greater importance. Accordingly, a ski boot in which the degree of flex can be adjusted permits each user to select the level of rigidity which meets his personal requirements of responsiveness and comfort.

In our U.S. Pat. No. 3,848,347, issued Nov. 19, 1974, there is described a ski boot in which the degree of flex can be adjusted by the user of the boot. The boot disclosed in this patent comprises a semi-rigid outer shell having a split portion which extends from the top of the shell in a direction toward the bottom thereof, the adjacent edges of the split being interconnected at a desired point along the length thereof, by means of an external clamp. When pressure is exerted at the top of the shell, the split portion separates along its length up to the point where the external clamp prevents separation. The degree of flex can be adjusted as desired by the position of the clamp along the split. With the clamp near the top of the split, minimum separation and therefore maximum rigidity is obtained, while with the clamp at the bottom of the split, the maximum amount of flex is obtained.

While the boot shown in said U.S. Pat. No. 3,848,347 affords the user the opportunity to select the degree of flex he desires, it has the disadvantage of requiring a tool for changing the position of the clamp when a change in the degree of flex is desired. Since the clamp is externally located on the boot, where it is subject to being dislodged by contact with the skier's skis, poles, or the ground, the clamp is secured by means of a threaded screw which is tightly locked in order to prevent inadvertent release. In order to reposition the clamp to a desired location, a screwdriver or other appropriate tool must be employed. In addition, the clamp, generally made of metal, is relatively expensive to produce.

The ski boot of the present invention overcomes the above-noted deficiency of the flexure systems in boots such as those depicted in U.S. Pat. No. 3,848,347. In common with the boot shown in that patent, the present invention employs a split portion in the shell of the boot which is clamped at a desired point along its length to provide adjustable flex. Unlike the previous boot, however, the boot of the present invention employs an internal clip having a base member with two spaced leg members attached thereto. The leg members of the clip are inserted into appropriately spaced apertures on either side of the split at a desired point along the length of the split portion. The clip is inserted from the interior of the boot and is kept in place at its desired location by reason of the fact that the base member of the clip abuts the skier's foot within the boot, or more typically, a padding liner disposed between the skier's foot and the base member of the clip. Accordingly, during use of the boot the clip is held firmly in position at its desired location and cannot be accidentally dislodged. When a change in flex is desired, however, it is a simple matter to remove and reposition the clip without the necessity for using any tools. In addition, the clip can be readily molded of a suitable plastic material rather than being machined of metal, thereby decreasing the cost of production.

The invention will be better understood from the following detailed description thereof, taken with the accompanying drawings, in which like numerals are used to refer to the same elements in the several views, and in which.

Figure 1:
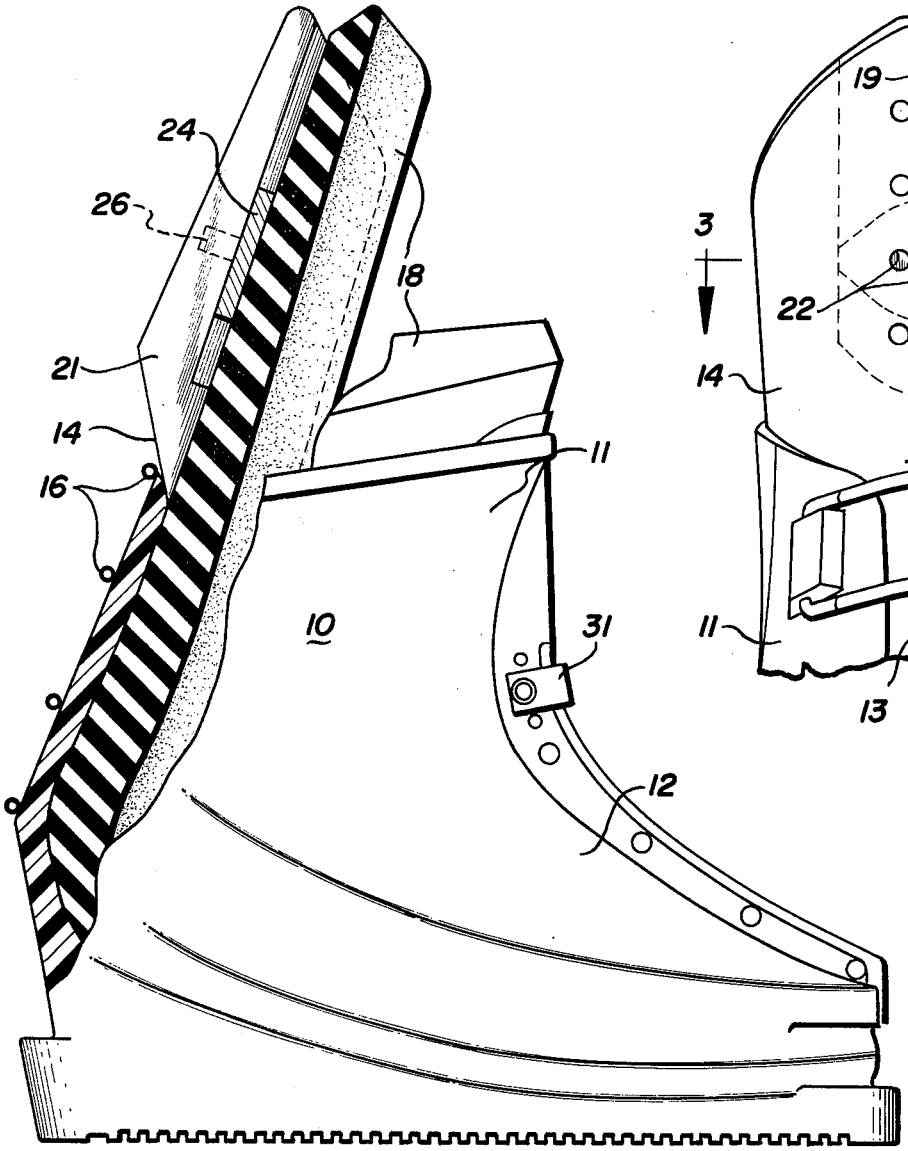
FIG. 1 represents a side view of a ski boot embodying the present invention, the rear of the boot being partially cut away to show the installation of the flex-controlling system of the invention.

In a typical embodiment of the invention, as shown in the drawings, a ski boot 10 of the rear entry type comprises a shell 11 including closed front vamp 12 having a rear opening 13 through which the skier's foot is inserted into the boot. The rear opening is closed by means of rear tongue 14 which is hinged at its bottom and held in closed position in conventional fashion by a closure system including an endless cable 16 and a buckle 17. Both vamp 12 and rear tongue 14 are preferably made from a semi-rigid or rigid plastic material which provides firm support for the skier's ankles and lower leg. It should be understood that as used herein and in the accompanying claims the term "shell" is intended to include the entire semi-rigid outer portion of the boot, including any individual closure members which may be used for permitting the entry of the skier's foot into the shell. Accordingly, in the embodiment shown the term "shell" encompasses not only the front vamp 12 of the boot but the rear tongue 14 as well.

In the embodiment shown, rear tongue 14 is of the high back, or "high-rise" form, such as that shown in our U.S. Pat. No. 3,803,730, issued Apr. 16, 1974. The present invention is not restricted to this type of boot, however, and can be used in any boot employing a substantially rigid outer shell.

Within shell 11 is inner liner 18 which preferably provides both fitting and padding functions for the skier's foot. Inner liner 18 may have a cavity filled with a thermoplastic material as shown in our U.S. Pat. No. 3,798,799, issued Mar. 26, 1974. Alternatively, liner 18 may comprise a resilient material such as foam rubber, polyurethane foam, or a flowable material in an envelope, as will be apparent to those skilled in the art. In the preferred embodiment, liner 18 covers the entire surface of the skier's foot including the rear portion thereof which comes into contact with tongue 14.

Figure 2:
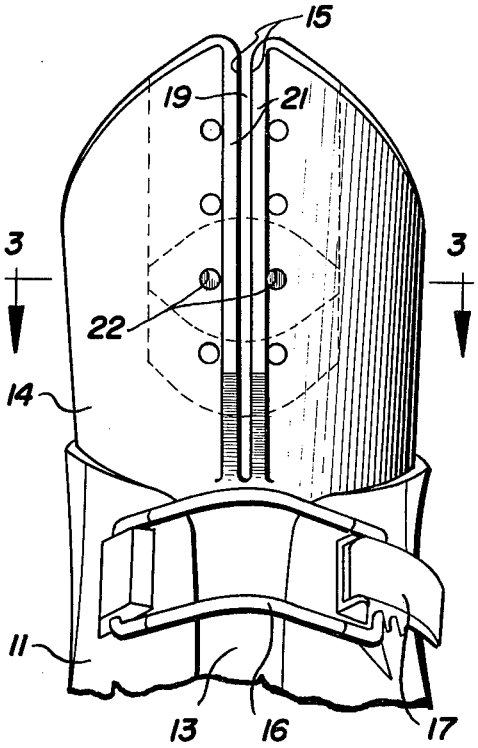
FIG. 2 is a view of the upper rear portion of the boot of FIG. 1 showing the flex-controlling split portion in the boot.

In one embodiment of the invention, as illustrated, the flex-controlling system of the invention is installed in the upper portion of rear tongue 14 and permits the skier to adjust to his own desires the degree of flex in this portion of the boot. As shown in FIG. 2, the upper portion of rear tongue 14 is provided with a split portion 19 defined in part by opposed generally parallel edges 15, the split starting at the top of the tongue and extending to a point just above cable 16 of the rear closure system. Positioned along the opposed edges of the split portion are stiffening ribs 21 which extend along the length of split portion 19. Immediately inboard of and adjacent ribs 21 are apertures 22 extending through the thickness of shell 11 arranged in pairs along the length of split portion 19.

Figure 3:
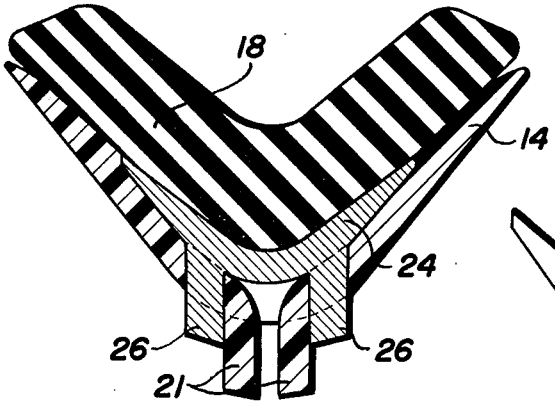
FIG. 3 is a sectional view along the line 3—3 of FIG. 2.
Figure 4:
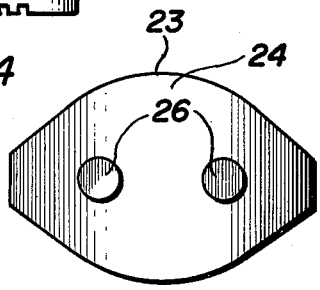
FIG. 4 is a front view of the clip used to control separation of the split portion shown in FIG. 2.
Figure 5:
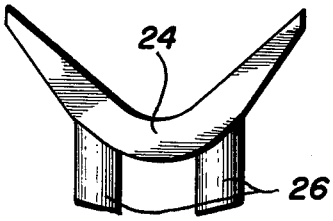
FIG. 5 is a top view of the clip of FIG. 4.

Control of the degree of flex in this portion of the boot is achieved by means of clip 23 shown in FIGS. 4 and 5, which is positioned at a desired location along split portion 19 to limit the degree of separation which the split portion will achieve on pressure at the top of tongue 14. As shown in FIGS. 4 and 5, clip 23 comprises a curved base member 24 provided with two generally parallel leg members 26 extending outwardly from base member 24. Leg members 26 have a contour and spacing therebetween which permits the leg members to be inserted through a selected pair of apertures 22, one on either side of split portion 19. Clip 23 is inserted from the inner surface of rear tongue 14, so that leg members 26 project outwardly, preferably in contact with the inner edges of ribs 21, and base member 24 abuts the inner surface of the tongue. As shown in FIGS. 1 and 3, clip 23 is inserted between the inner surface of tongue 14 and the outer surface of liner 18. In order to permit such insertion, it is necessary that the abutting surfaces of tongue 14 and liner 18 be unattached in this area, in order to permit access to the inner surface of tongue 14, typically by bending liner 18 forwardly to expose the inner side of split 19.

The base member 24 of clip 23 is shaped to follow the contour of the inner surface of tongue 14, as shown in FIG. 3, in order to permit a close fit to the skier's foot. For this purpose, it is also advantageous to undercut the inner surface of tongue 14 to accommodate the thickness of base member 24. As shown in FIG. 3, legs 26, projecting through a selected pair of apertures 22, abut the edges of ribs 21 and prevent separation of split portion 19 below the point of attachment of clip 23. By positioning the clip at a point near the top of the split portion, the amount of separation and hence the degree of flex is limited, greater flex being provided by lowering the point of attachment of the clip member.

In the embodiment shown in FIG. 1, the boot is provided with a flex controlling external clamp 31, similar to that shown in our U.S. Pat. No. 3,848,347. It should be understood, however, that, in accordance with the invention, the same means for flex-control shown in FIG. 1 in tongue 14 can also be used to control the flex in the front or in any other portion of the shell of the boot, as will be apparent to those skilled in the art.

The foregoing detailed description has been given for clearness of understanding only, and no unnecessary limitations should be understood therefrom as modifications will be obvious to those skilled in the art.

What is claimed is:

1. A ski boot with means for adjusting the flex in the boot, said boot comprising a semi-rigid shell having a closure system for closing said shell about the foot of a wearer, said shell having a split portion commencing at the top of said boot and extending toward the bottom thereof, said split portion being defined in part by a pair of opposed generally parallel edges;

said shell being provided with a plurality of opposed apertures adjacent the edges of said split; and clip means for interconnecting the edges of said split portion at a desired point along the length thereof corresponding to the location of an opposed pair of said apertures;

said clip means comprising a base member and spaced generally parallel leg members extending outwardly from said base member, each leg member being adapted to be received in one of said apertures, said clip being positioned with said base member within said shell and said leg members projecting outwardly through said apertures;

whereby upon exertion of pressure on said boot, the shell is adapted to separate along the length of said split portion from the top of the boot to the location where said clip means connects the edges of said split portion.

2. A boot in accordance with claim 1 wherein the edges of said split portion are provided with outwardly-extending ribs along at least a portion of the length of said split.

3. A ski boot with means for adjusting the flex in the boot, said boot comprising a semi-rigid shell having a closure system for closing said shell about the foot of a wearer, said shell having a split portion commencing at the top of said boot and extending toward the bottom thereof, said split portion being defined in part by a pair of opposed generally parallel edges;

said shell being provided with a plurality of opposed apertures adjacent the edges of said split;

said split portion having outwardly extending ribs adjacent said edges along at least a portion of the length of said split; and clip means for interconnecting the edges of said split portion at a desired point along the length thereof corresponding to the location of an opposed pair of said apertures;

said clip means comprising a base member and spaced generally parallel leg members extending outwardly from said base member, each leg member being adapted to be received in one of said apertures, said clip being positioned with said base member within said shell, said leg members projecting outwardly through said apertures beyond the surface of said shell and bearing against the sides of said ribs;

whereby upon exertion of pressure on said boot, the shell is adapted to separate along the length of said split portion from the top of the boot to the location where said clip means connects the edges of said split portion.

4. A boot in accordance with claim 3 wherein said shell comprises a vertical tongue member adapted to close a rear entry to said boot, said tongue member being provided with said split portion starting at the top and extending toward the bottom thereof, said clip being used in conjunction with said split in said tongue to control the degree of flex of said tongue.

5. A boot in accordance with claim 4 wherein said tongue extends vertically to a point substantially above the remainder of said shell.

6. A boot in accordance with claim 3 in which the inner surface of said shell is undercut to receive the base member of said clip, and the inner surface of said base member is contoured to match the inner surface of said shell.

* * * * *